US007081054B1

(12) United States Patent
Nikkel

(10) Patent No.: US 7,081,054 B1
(45) Date of Patent: Jul. 25, 2006

(54) GOLF BALL AIMING AND STRIKING AID

(76) Inventor: Gerald W. Nikkel, 54261 Road 200, North Fork, CA (US) 93643

( * ) Notice: Subject to any disclaimer, the term of this patent is extended or adjusted under 35 U.S.C. 154(b) by 0 days.

(21) Appl. No.: 11/193,803

(22) Filed: Aug. 1, 2005

(51) Int. Cl.
*A63B 69/36* (2006.01)

(52) U.S. Cl. ..... 473/278; 473/279

(58) Field of Classification Search ..... 473/218, 473/266–278, 279; D21/791, 792
See application file for complete search history.

(56) References Cited

U.S. PATENT DOCUMENTS

| | | | | |
|---|---|---|---|---|
| 4,000,905 | A | 1/1977 | Shirhall | |
| 4,101,130 | A | 7/1978 | Richards | |
| 4,146,231 | A | 3/1979 | Merkle et al. | |
| D271,319 | S | 11/1983 | Barty, Jr. | |
| 4,538,815 | A * | 9/1985 | Poirier | 473/218 |
| 4,915,387 | A | 4/1990 | Baxstrom | |
| 5,042,815 | A * | 8/1991 | Sutton | 473/218 |
| 5,131,659 | A * | 7/1992 | Lindberg, Jr. | 473/267 |
| D365,619 | S * | 12/1995 | Foster | D21/792 |
| D372,288 | S | 7/1996 | Deics | |
| 5,893,805 | A * | 4/1999 | Douglass | 473/218 |

* cited by examiner

*Primary Examiner*—Nini F. Legesse

(57) ABSTRACT

A golf ball aiming and striking aid includes a mat that has a top side and a bottom side. The mat has a back edge and a front edge. The back edge is straight. Aim indicia is positioned on the top side and comprises a line positioned adjacent to and orientated parallel to the back edge. Stance indicia is positioned on the top side and comprises a line positioned between the front edge and is orientated parallel to the back edge. An elongated panel is rotatably coupled to the top side. The panel is selectively alignable with the aim indicia or angled with respect to the aim indicia. A golf ball may be positioned between the aim indicia and the stance indicia and a golfer may align themselves with the stance indicia to form a proper stance.

4 Claims, 3 Drawing Sheets

GOLF BALL AIMING AND STRIKING AID

BACKGROUND OF THE INVENTION

1. Field of the Invention

The present invention relates to golf shot aiming devices and more particularly pertains to a new golf shot aiming device for aiding a person in proper alignment and stance for a variety of different golf shots.

2. Description of the Prior Art

The use of golf shot aiming devices is known in the prior art. U.S. Pat. No. 4,101,130 describes a mat that includes a plurality of lines that are parallel or perpendicular to a target to aid a person in improving aim. Another type of golf shot aiming device is U.S. Pat. No. 4,000,905 having a mat having a plurality of markings thereon for directing a person to proper ball placement relative to their feet depending on the type of golf club being used. Yet another such device is found in U.S. Pat. No. 4,915,387 and again includes a mat having indicia thereon for directing a person to a particular alignment and ball placement.

While these devices fulfill their respective, particular objectives and requirements, the need remains for a device that visually signals a person not only to how their stance should be set up but also which indicates swing plane and projected ball path or club face aiming in order to achieve a particular shot. This will allow a golfer to not only learn to aim correctly for a straight shot but will also teach the swing plane and club face orientation for drawing and fading a golf ball.

SUMMARY OF THE INVENTION

The present invention meets the needs presented above by generally comprising a mat that has a top side and a bottom side. The mat has a back edge and a front edge. The back edge is straight. Aim indicia is positioned on the top side and comprises a line positioned adjacent to and orientated parallel to the back edge. Stance indicia is positioned on the top side and comprises a line positioned between the front edge and is orientated parallel to the back edge. An elongated panel is rotatably coupled to the top side. The panel is selectively alignable with the aim indicia or angled with respect to the aim indicia. A golf ball may be positioned between the aim indicia and the stance indicia and a golfer may align themselves with the stance indicia to form a proper stance.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
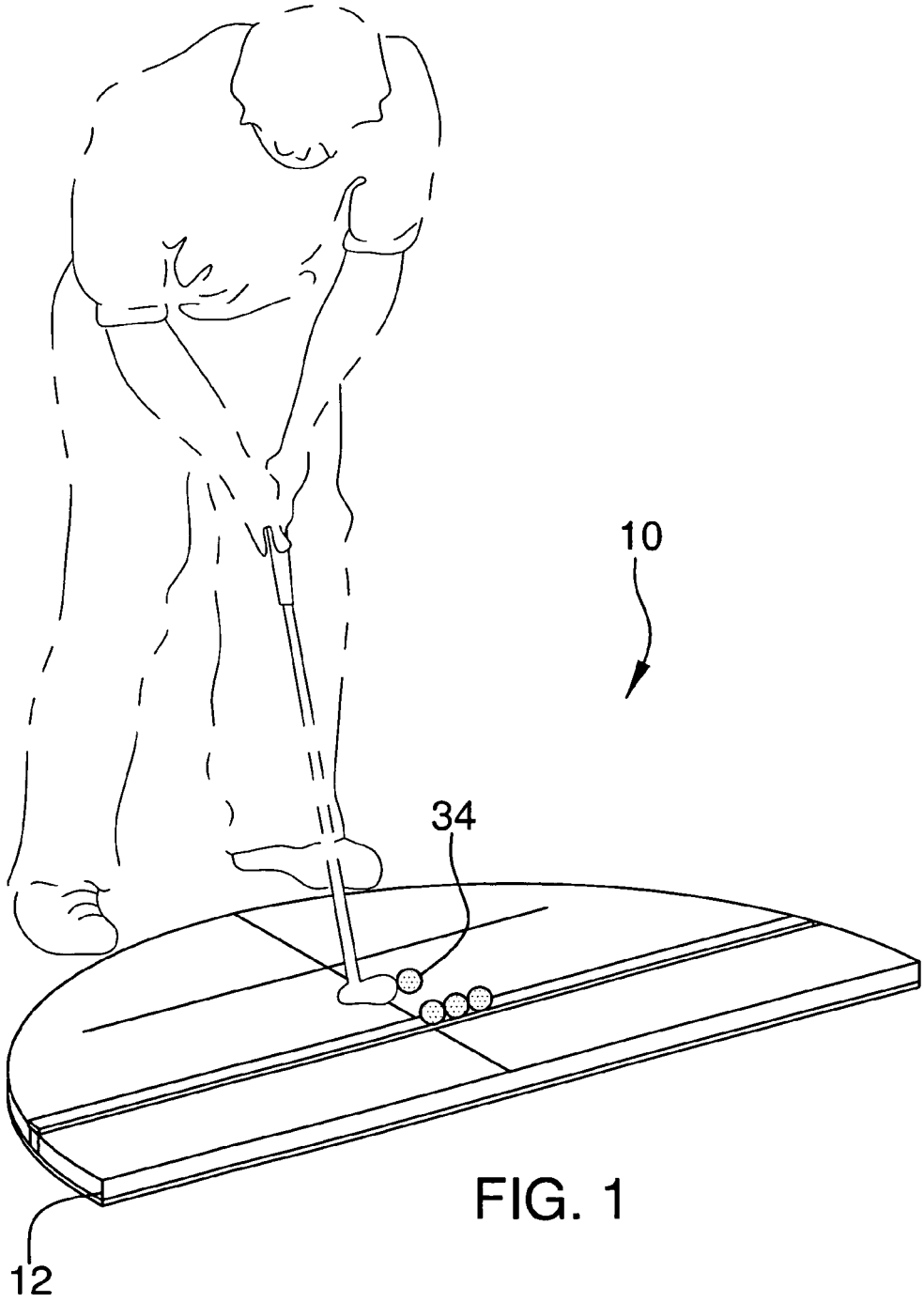
FIG. 1 is a perspective view of a golf ball aiming and striking aid according to the present invention.
Figure 2:
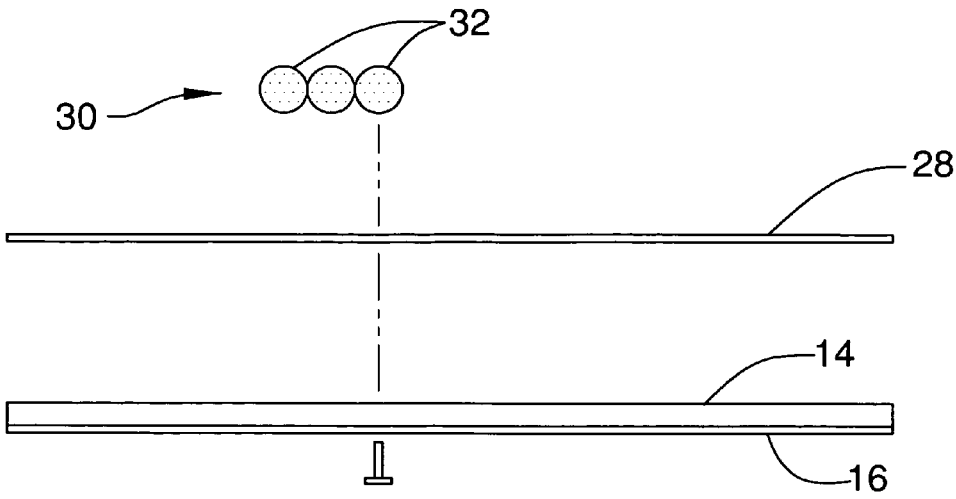
FIG. 2 is an expanded side view of the present invention.
Figure 3:
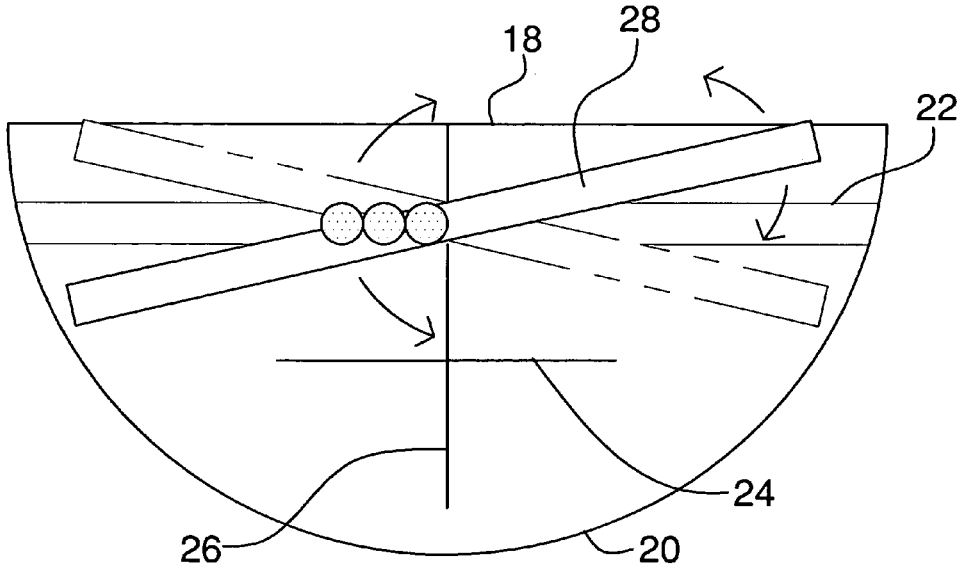
FIG. 3 is a top view of the present invention.
Figure 4:
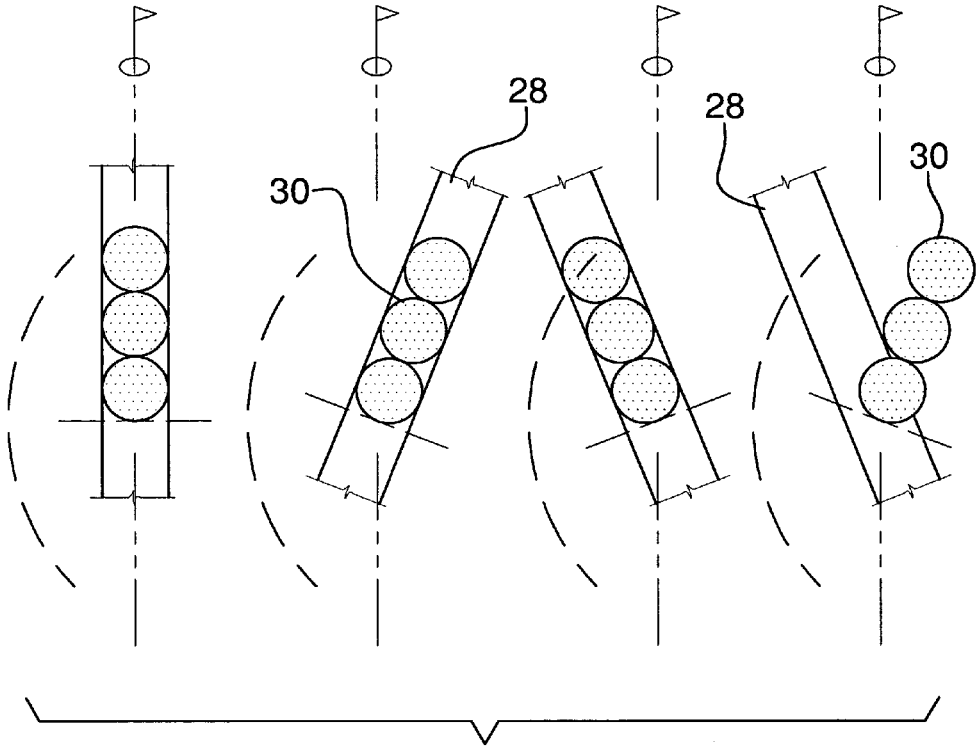
FIG. 4 is a top view of a plurality of aiming variations of the present invention.

With reference now to the drawings, and in particular to FIGS. 1 through 4 thereof, a new golf shot aiming device embodying the principles and concepts of the present invention and generally designated by the reference numeral 10 will be described.

As best illustrated in FIGS. 1 through 4, the golf ball aiming and striking aid 10 generally comprises a resiliently compressible mat 12 has a top side 14 and a bottom side 16. The mat 12 has a back edge 18 and a front edge 20. The back edge 18 is straight and the front edge 20 is preferably arcuate. The mat has a length between 2½ and 4 feet along the back edge 18.

Aim indicia 22 are positioned on the top side 14 and comprises a line positioned adjacent to and orientated parallel to the back edge 18. Stance indicia 24 are positioned on the top side 14 and comprises a line positioned between the front edge 20 and the aim indicia 22 and which is orientated parallel to the back edge 18. Ball line indicia 26 are positioned on the top side 14 and comprises a line extending from the back edge 18 and toward the front edge 20. The ball line indicia 26 bisects and are orientated perpendicular to the stance 24 and aim 22 indicia.

An elongated panel 28 is rotatably coupled to the top side 14. The panel 28 is selectively alignable with the aim indicia 22 or angled with respect to the aim indicia 22. A club face alignment member 30 is rotatably attached to the elongated panel 28 and has a longitudinal axis is selectively angled with respect to the panel 28. The club face alignment member 30 includes a plurality of spheres 32 attached together in alignment with each other. Each of the spheres 32 is comprised of a foamed elastomeric material and has a size generally equal to the size of a standard golf ball. An end one of the spheres 32 is rotatably coupled to the panel 28.

In use, a golf ball 34 may be positioned between the aim indicia 22 and the stance indicia 24 and a golfer may align themselves with the stance indicia to form a proper stance. The ball line indicia 26 allows a person to move a golf ball forward or rearward in their stance more accurately and with better feedback. The panel 28 and club face alignment member 30 may be angled with respect to each other and the aim indicia 22. The club face alignment member 30 provides feedback as to the direction in which the club face should be aimed for a particular shot by providing a visual reference to the proper direction of ball take off. The panel 28 provides swing plane direction. Thus, if a person would like to practice hitting a left to right shot, they would aim the panel 28 inward and the line of spheres 32 outwardly. The person would then place a golf ball 34 on the mat between the stance 24 and aim indicia 22 and strike the golf ball 34 with the club face alignment and swing plane directed by the aid 10. If a person wants to practice hitting a straight shot, they simply place the panel 28 and club face alignment member 30 in parallel with the aim indicia 22. The arcuate front edge 20 allows a person to stand near, but remain off of, the mat.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf shot aiming assembly comprising:

a mat having a top side and a bottom side, said mat having a back edge and a front edge, said back edge being straight;

aim indicia being positioned on said top side and comprising a line positioned adjacent to and orientated parallel to said back edge;

stance indicia being positioned on said top side and comprising a line positioned between said front edge and being orientated parallel to said back edge;

an elongated panel being rotatably coupled to said top side, said panel being selectively alignable with said aim indicia or angled with respect to said aim indicia;

a club face alignment member being rotatably attached to said elongated panel and having a longitudinal axis being selectively angled with respect to said panel, said club face alignment member including a plurality of spheres attached together in alignment with each other; and wherein a golf ball may be positioned between the aim indicia and the stance indicia and a golfer may align themselves with the stance indicia to form a proper stance.

2. The assembly according to claim 1, wherein said front edge is arcuate.

3. The assembly according to claim 1, further including ball line indicia being positioned on said top side and comprising a line extending from said back edge, said ball line indicia bisecting and being orientated perpendicular to said stance and aim indicia.

4. A golf shot aiming assembly comprising:

a mat having a top side and a bottom side, said mat having a back edge and a front edge, said back edge being straight and said front edge being arcuate;

aim indicia being positioned on said top side and comprising a line positioned adjacent to and orientated parallel to said back edge;

stance indicia being positioned on said top side and comprising a line positioned between said front edge and said aim indicia and being orientated parallel to said back edge;

ball line indicia being positioned on said top side and comprising a line extending from said back edge and toward said front edge, said ball line indicia bisecting and being orientated perpendicular to said stance and aim indicia;

an elongated panel being rotatably coupled to said top side, said panel being selectively alignable with said aim indicia or angled with respect to said aim indicia;

a club face alignment member being rotatably attached to said elongated panel and having a longitudinal axis being selectively angled with respect to said panel, said club face alignment member including a plurality of spheres attached together in alignment with each other, an end one of said spheres being rotatably coupled to said panel; and wherein a golf ball may be positioned between the aim indicia and the stance indicia and a golfer may align themselves with the stance indicia to form a proper stance.

* * * * *